US007527391B2

(12) United States Patent
Wu

(10) Patent No.: US 7,527,391 B2
(45) Date of Patent: May 5, 2009

(54) LIGHTING BOARD USING CASSETTE LIGHT UNIT

(76) Inventor: Jiahn-Chang Wu, No. 15, Lane 13, Alley 439, Her-Chiang Street, Chutung, Hsin-Chu (TW) 310

( * ) Notice: Subject to any disclaimer, the term of this patent is extended or adjusted under 35 U.S.C. 154(b) by 87 days.

(21) Appl. No.: 11/458,810

(22) Filed: Jul. 20, 2006

(65) Prior Publication Data

US 2007/0147047 A1 Jun. 28, 2007

(30) Foreign Application Priority Data

Dec. 23, 2005 (TW) ..... 94145968 A

(51) Int. Cl.
*F21S 6/00* (2006.01)

(52) U.S. Cl. ..... 362/257; 362/654; 362/512; 362/545; 362/800; 257/98; 257/99; 257/100

(58) Field of Classification Search ..... None
See application file for complete search history.

(56) References Cited

U.S. PATENT DOCUMENTS 3,676,668 A * 7/1972 Collins et al. ..... 313/499
3,821,775 A * 6/1974 Biard ..... 257/98
4,999,755 A * 3/1991 Lin ..... 362/250
5,848,837 A * 12/1998 Gustafson ..... 362/235
6,257,736 B1 * 7/2001 Fehrenbach ..... 362/640
6,461,019 B1 * 10/2002 Allen ..... 362/249
7,108,391 B2 * 9/2006 Chuang ..... 362/122
7,218,041 B2 * 5/2007 Isoda ..... 313/11
2007/0253209 A1 * 11/2007 Loh et al. ..... 362/458

* cited by examiner

*Primary Examiner*—Sandra L O'Shea
*Assistant Examiner*—Danielle Allen
(74) *Attorney, Agent, or Firm*—Lowe, Hauptman, Ham & Berner, LLP

(57) ABSTRACT

A lighting board is made with a receptacle substrate accommodated to accept cassette light units. The convenience of assembly and disassembly of the light unit from the receptacle substrate makes the product easily to be maintained for changing different color light units, changing different displaying patterns, remove or replace a failed light unit in the lighting board.

17 Claims, 6 Drawing Sheets

LIGHTING BOARD USING CASSETTE LIGHT UNIT

RELATED APPLICATIONS

The present application is based on, and claims priority from, Taiwan Application Serial Number 094145968, filed Dec. 23, 2005, the disclosure of which is hereby incorporated by reference herein in its entirety.

BACKGROUND OF THE INVENTION

1. Field of the Invention

This invention relates to a lighting board that can be used as a display, automobile lights including but not limited to headlights or taillights, indicator, decorating display, advertising display, and lighting board units in entertainment equipments . . . etc.

2. Description of the Related Art

FIG. 1 illustrates a traditional lighting board which includes a printed circuit board (PCB) 10 and a plurality of light-emitting diode chips 11 Each of the diodes has bottom electrodes 11*a* and 11*b*. Corresponding metal circuits 10*a* and 10*b* are provided on the board 10 to electrically couple with the electrodes 11*a* and 11*b* of the light-emitting diode chip 11 respectively to form a traditional light-emitting diode display board. The shortcomings of the prior art are as follows: (1) inflexibility, i.e., it is impossible or inconvenient to change different light color chips as desired; (2) difficult maintenance and repair, i.e., it is difficult to replace a failed diode chip.

There is a need for a cassette light unit with a receptacle substrate on which corresponding receptacle slots are provided so that a user can easily change different color light unit at any moment, and easily maintain the lighting board, and rapidly replace any failed light unit 500.

SUMMARY OF THE INVENTION

The primary object of the present invention is to prepare a lighting board that is convenient for assembly and disassembly of the light units from the lighting board. A second object of the present invention is to provide a lighting board that is easily to be maintained for changing different color light units, or changing different displaying patterns. A third object of the present invention is to provide a lighting board that allows a user to easily and rapidly replace a failed light unit.

A lighting board using a cassette light unit, comprising: a cassette light unit has a top layer electrode plate; a bottom layer electrode plate, and a transparent unit is made at the top of the light unit for modifying the light beam emitted from a light chip. A receptacle substrate has a pair of elastic parallel cantilevers coupling with the top layer electrode plate of the cassette unit being inserted. A second metal uses as a base metal electrically coupling with the bottom layer electrode plate of the cassette light unit. The open area between the parallel cantilevers is for the accommodation of the protruded transparent head of the light unit. A slit is formed between the first metal plate and the second metal plate for the insertion of the light unit into the receptacle substrate. An insulation material is positioned in between the first metal plate and the second metal plate for electrical isolation there between.

The cassette light unit in the present invention comprises: a light-emitting diode chip, the light-emitting diode chip has a first electrode and a second electrode; a top layer electrode plate electrically couples with the first electrode of the light-emitting diode chip; a bottom layer electrode plate electrically couples with the second electrode of the light-emitting diode chip. The top layer electrode plate has an open area to accommodate the light-emitting diode chip onto the bottom layer electrode plate. An insulation material is positioned in between the top layer electrode plate and the bottom layer electrode plate for electrical insulation there between. A transparent head is positioned above the light-emitting diode chip and protruded above the top layer electrode plate for modifying the light beam emitted from a light chip.

The present invention uses a cassette light unit that is convenient for assembly and disassembly from the lighting board, and it is convenient to change different color light units, and it is easy to rapidly remove or replace a failed light unit.

DETAILED DESCRIPTION OF THE PREFERRED EMBODIMENTS

Figure 1:
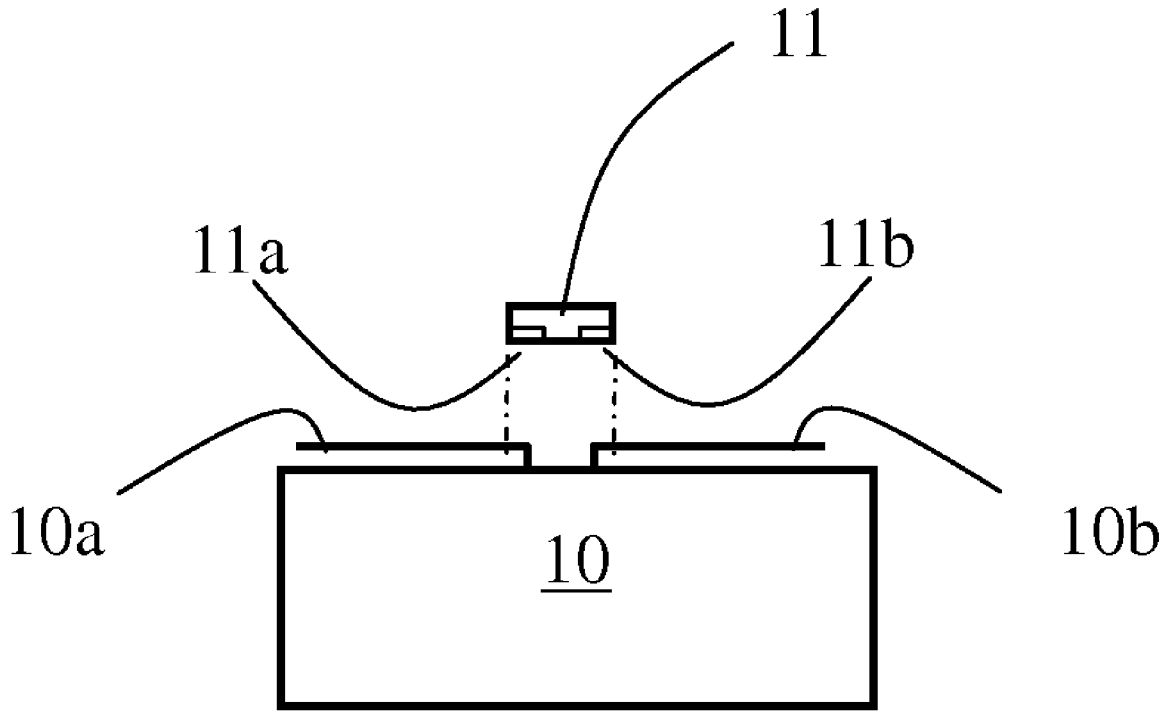
Fig. 1 Prior Art
FIG. 1 is a traditional lighting board.
Figure 2:
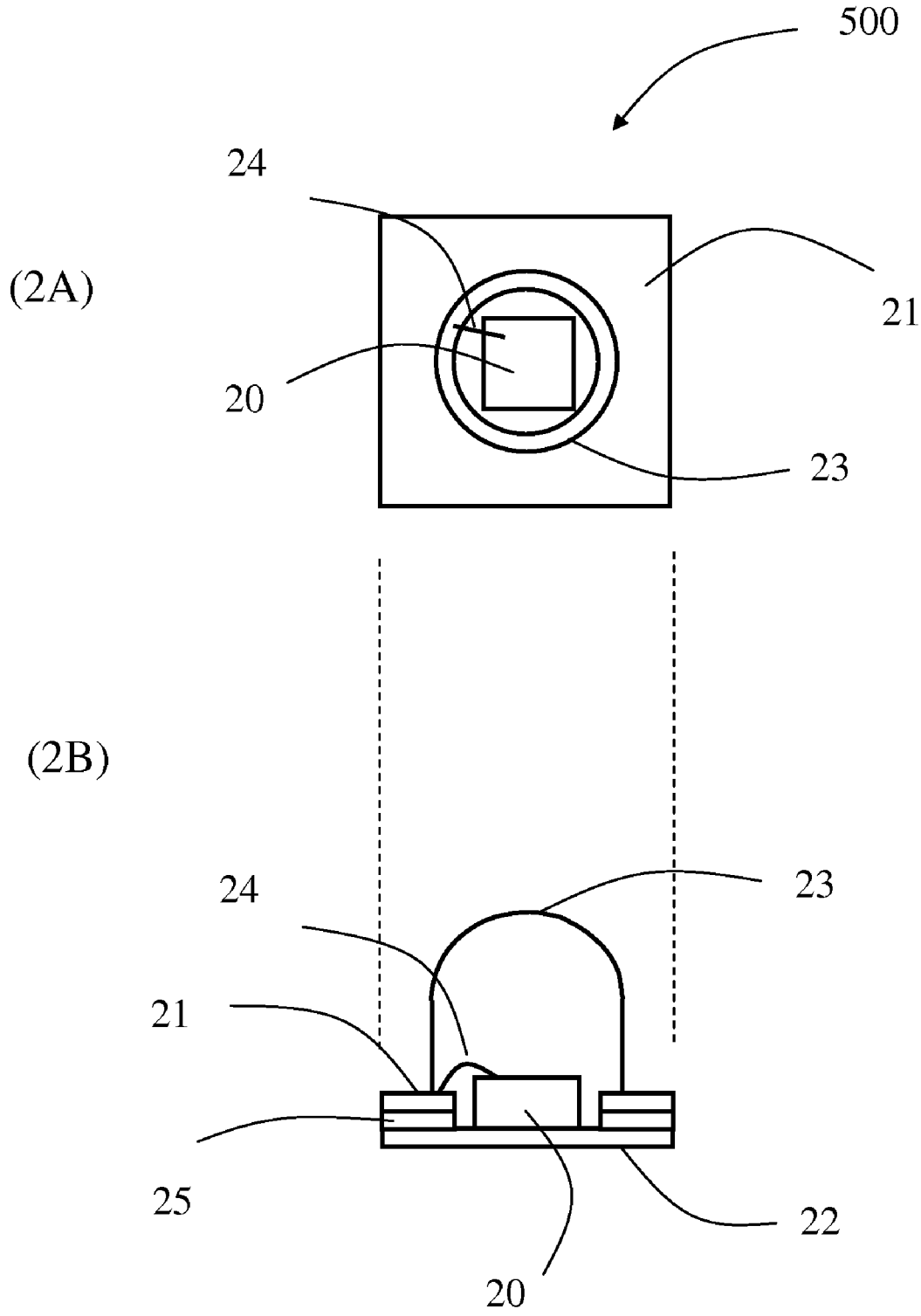
FIG. 2A is a top view of a cassette light unit used in the present invention.
FIG. 2B is a side view of FIG. 2A.

FIG. 2A is a top view of the light unit 500 used in this present invention. It shows a cassette light unit 500 that encapsulates a light-emitting diode chip 20. The first electrode or surface electrode of the light-emitting diode chip 20 is electrically coupled with the top electrode plate 21 through a bonding wire 24. The top layer electrode plate 21 has an open area at its center to be inserted and mounting a light-emitting diode chip 20 onto the bottom layer electrode plate 22. The second electrode or bottom electrode of the light-emitting diode chip 20 is electrically coupled with the bottom layer electrode plate 22. A transparent head 23 is made to cap over and above the light-emitting diode chip 20 for modifying the emitted light and to ensure the reliability of the product.

FIG. 2B is a side view of the light unit 500 of FIG. 2A, present invention. It shows the cassette light unit 500 that comprises: a light-emitting diode chip 20 mounted on the bottom layer electrode plate 22 through an open area of the top layer electrode plated 21. The top layer electrode plate 21 is electrically coupled with the first electrode or surface electrode of the light-emitting diode chip 20 through a metal wire 24. The bottom layer electrode plate 22 is electrically coupled with the second electrode or bottom face electrode of the light-emitting diode chip 20. A transparent head 23 is arranged above the light-emitting chip 20 to modify the emitted light. An insulation material 25 is positioned between the top layer electrode plate 21 and the bottom layer electrode plate 22 for electrical insulation there between.

Figure 3:
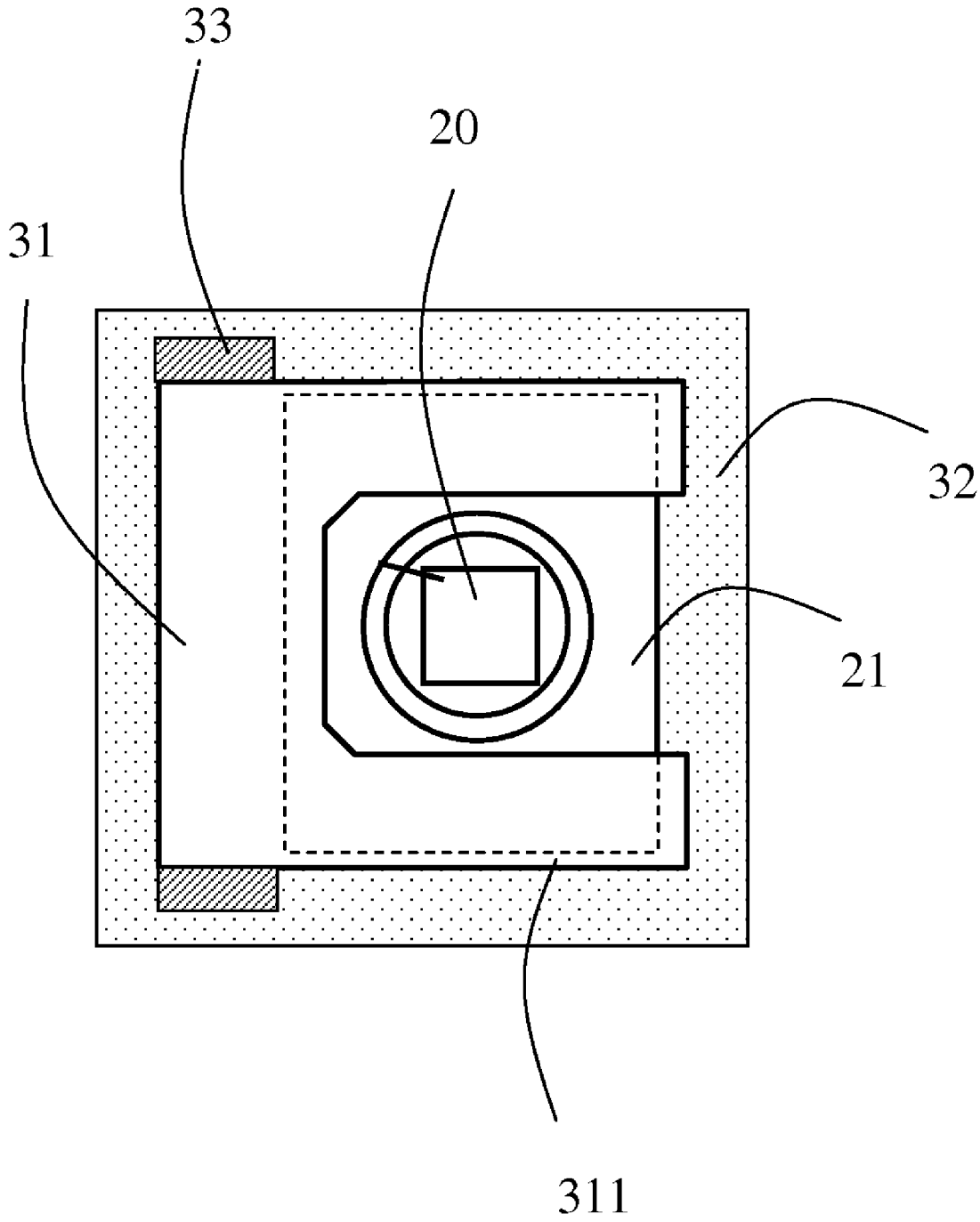
FIG. 3 is a top view of a first embodiment of the present invention with a single light unit.
Figure 4:
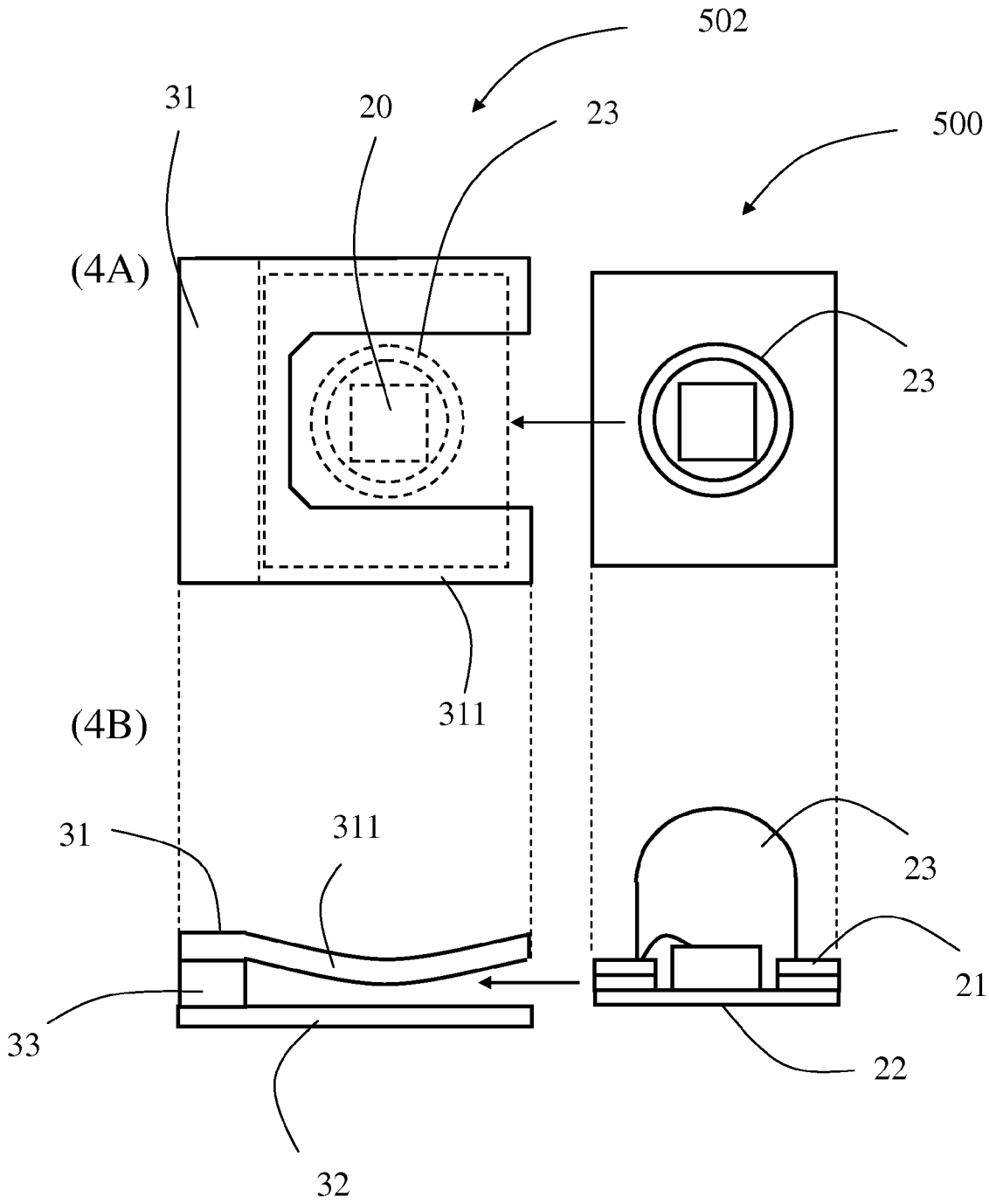
FIG. 4A is a top view of a lighting board of the present invention before insertion of a light unit.
FIG. 4B is a side view of FIG. 4A.

FIG. 3 is a top view of a first embodiment of the present invention with a single light unit 500. A lighting board with a single cassette light unit 500 of the present invention is shown. A receptacle substrate 502 (FIG. 4) of the lighting board has a first metal sheet 31 and a second metal sheet 32. The first metal sheet 31 has a pair of elastic cantilevers 311 which will hold the periphery of the top layer electrode plate 21 of the cassette light unit 500 steadily, so as to fix the cassette light unit 500 when it is inserted in position. At least one elastic cantilever 311 is electrically coupled with the top layer electrode plate 21 of the cassette light unit 500. The parallel elastic cantilever 311 has an open area for accommodation the protruded head 23 of the cassette light unit 500. An insulation material 33 is disposed in between the first metal sheet 31 and the second metal sheet 32.

FIG. 4A is a top view of a lighting board of the present invention before insertion of a light unit 500. The top metal sheet 31 has parallel elastic cantilevers 311. A light unit 500 is inserted in the open area between the parallel cantilevers 311. The dotted lines denote inserted and positioned status of the cassette light unit 500. The transparent head 23 is protruded above the first metal sheet 31.

FIG. 4B is a side view of FIG. 4A. A cassette light unit 500 is waiting to be inserted into a slot of the receptacle substrate 502. It shows that the receptacle substrate 502 has a first metal 31 and a second metal 32, and an insulating material 33 disposed in between the first metal 31 and the second metal 32. The first metal 31 has a pair of parallel elastic cantilevers 311 that is used for holding the inserted cassette light unit 500 with elasticity. At least one elastic cantilever 311 is electrically coupled with the top layer electrode plate 21 of the cassette light unit 500 and the second metal 32 is electrically coupled with the bottom layer electrode plate 22 of the cassette light unit 500 when the cassette light unit 500 is inserted in the receptacle substrate 502. Due to the small size of the cassette light unit 500, the protruded transparent head 23 can be used as a grip for handling for assembly and disassembly of the light unit 500.

Figure 5:
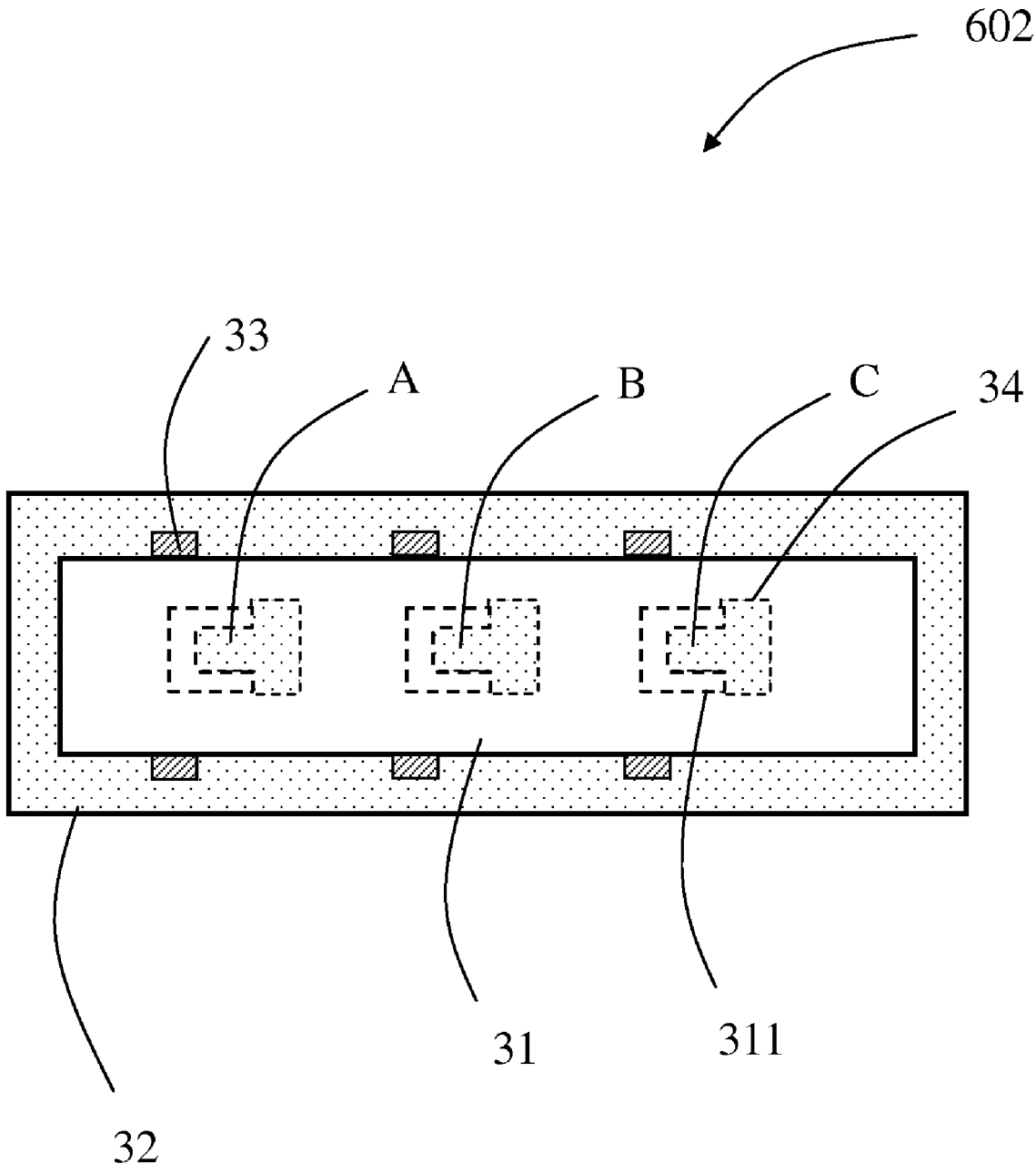
FIG. 5 is a top view of a lighting board of a second embodiment of the present invention with multiple light unit slots.

FIG. 5 is a top view of a second embodiment of the present invention with multiple light unit slots. A line shaped lighting board receptacle substrate 602 is shown, in which a first metal 31 overlies second metal 32 and insulation layer 33 is inserted between the first metal 31 and the second metal 32. Parallel cantilevers 311 are made elastically bending toward the second metal 32. The open area between the parallel cantilevers 311 is for accommodation of the transparent protruded head 23 of the light unit 500. The slot between the cantilever 311 and the second metal 32 is for the insertion and holding of the light unit 500(not shown in this figure).

Figure 6:
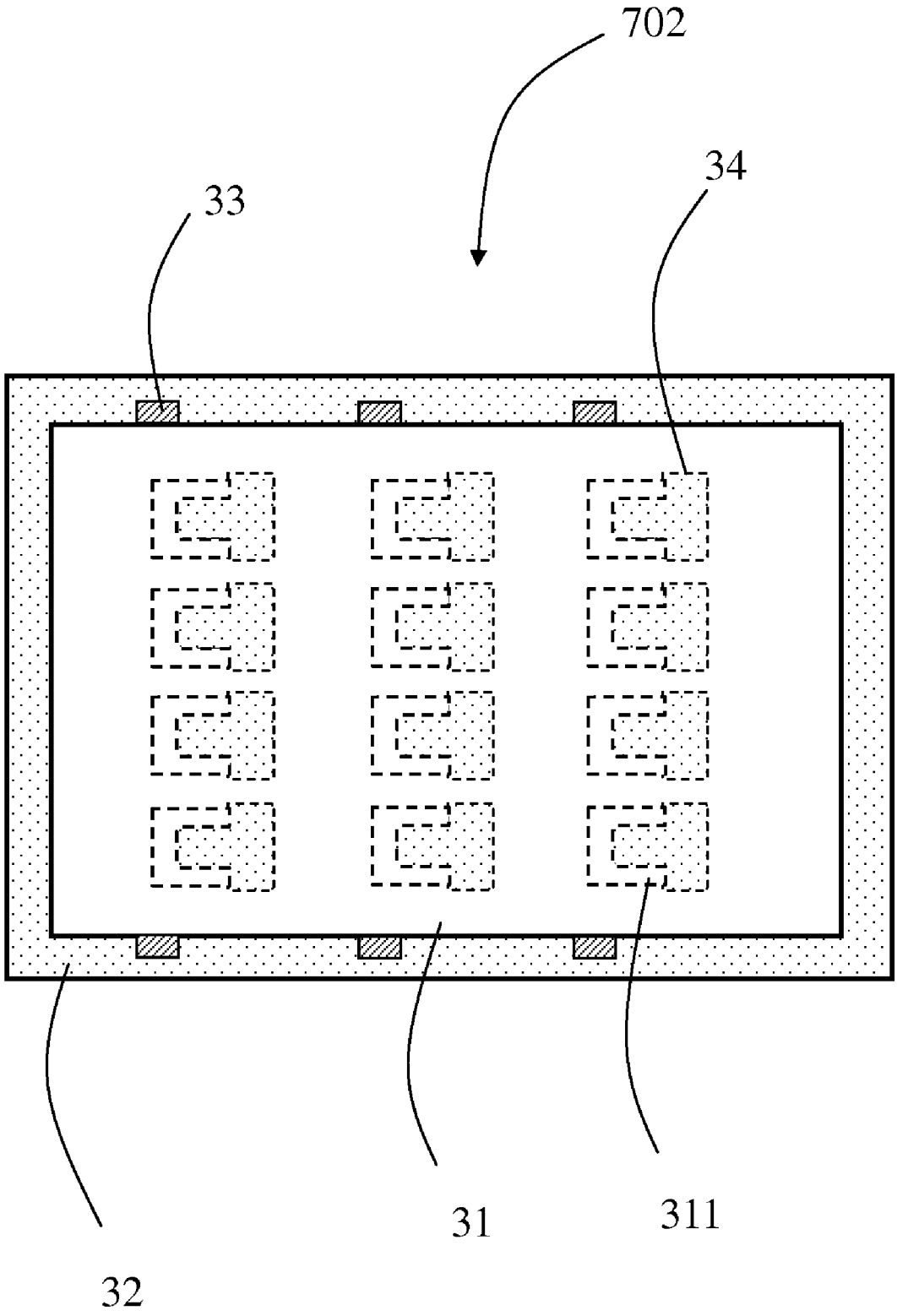
FIG. 6 is a top view of a third embodiment of the present invention with a matrix light unit slots.

FIG. 6 is a top view of a third embodiment of the present invention with matrix light unit slots. A matrix lighting board 702 is illustrated as having 4×3 receptacle slots, each slot for receiving a cassette light unit 500 (not shown in this figure). The principle of this embodiment likes those that have been described above.

The transparent head 23 of the present invention can be in the shape of a lamp bulb, so as to modify the emitting light. The transparent head 23 can be made into different shapes, e.g., animals, plants, people, mountain or river sceneries, knifes or forks and buildings etc. The product shall emit the light from the embedded light chip when the light unit is inserted into the receptacle in position, and become a lighting sculpture product.

The transparent head 23 can be a thin layer protection glue for protecting the elements underneath to boost the product reliability.

While the preferred embodiments have been described, it will be apparent to those skilled in the art that various modifications may be made without departing from the spirit of the present invention. Such modifications are all within the scope of the present invention as defined in the attached claims.

What is claimed is:

1. A lighting board, comprising:

(1) a cassette light unit, having a top layer electrode plate, a bottom layer electrode plate, and a transparent head, said top layer electrode plate having a flat surface wherein partial areas of the surface are exposed;

(2) a receptacle substrate, having a first metal electrically coupled with said top layer electrode plate through said exposed areas, a second metal parallel with said first metal and electrically coupled with said bottom layer electrode plate, said first metal having an open area for light emitting;

(3) a lateral slot between said first metal and second metal for insertion of said light unit; and (4) an insulating material between said first metal and said second metal.

2. The lighting board as claimed in claim 1, wherein said lighting board is a strip shaped lighting board with a plurality of cassette light units arranged in a line.

3. The lighting board as claimed in claim 1, wherein said lighting board is a matrix lighting board with a plurality of cassette light units arranged in a matrix.

4. The lighting board as claimed in claim 1, wherein said transparent head is a layer of protection glue.

5. The lighting board as claimed in claim 1, wherein said transparent head is of a shape selected from the group consisting of: animal, plant, natural scenery, and articles.

6. A cassette light unit, comprising:

(1) a light-emitting diode chip, having a first electrode and a second electrode;

(2) a top layer electrode plate electrically coupled with said first electrode and having a flat surface wherein at least partial areas of the surface are exposed;

(3) a bottom layer electrode plate electrically coupled with said second electrode, said top layer electrode plate having an open area for mounting said light-emitting diode chip onto said bottom layer electrode plate;

(4) an insulating material between said top layer electrode plate and said bottom layer electrode plate; and (5) a transparent head formed over said light-emitting diode chip.

7. The cassette light unit of claim 6, wherein the transparent head extends from the bottom layer electrode plate upwardly beyond a topmost surface of the top layer electrode plate.

8. The lighting board of claim 1, wherein the first metal includes at least an elastic cantilever that contacts the top layer electrode plate and holds the cassette light unit down against the second metal for fixing the cassette light unit in place after the cassette light unit has been inserted in the slot.

9. The lighting board of claim 8, wherein said elastic cantilever is bent downward toward the second metal for elastically holding the cassette light unit in place.

10. The lighting board of claim 1, wherein said first metal includes two elastic cantilevers that are bent downward toward the second metal for contacting the top layer electrode plate and elastically holding the cassette light unit down against the second metal for fixing the cassette light unit in place after the cassette light unit has been inserted in the slot;

at least one of said elastic cantilevers is electrically coupled with the top layer electrode plate; and said elastic cantilevers are spaced from one another to define therebetween the open area in which the transparent head of the cassette light unit is received.

11. A lighting board, comprising:

a cassette light unit that includes an LED chip, top and bottom layer electrode plates electrically coupled to respective terminals of the LED chips, and a transparent head formed over the LED chip;

a receptacle substrate that includes first and second metals spaced from each other by a spacing in which the cassette light unit is removably insertable so that the top and bottom layer electrode plates are (i) sandwiched between the first and second metals and (ii) in electrical contact with the first and second metals, respectively; and an insulating material between said first and said second metals;

wherein said first metal has a cut-out portion defining an open area in which the transparent head is received when the cassette light unit is inserted into the receptacle.

12. The lighting board of claim 11, wherein the first metal includes at least an elastic arm supported in cantilever fashion by the insulating material, said elastic arm contacting the top layer electrode plate and elastically pressing the cassette light unit down against the second metal for fixing the cassette light unit in place after the cassette light unit has been inserted in the receptacle.

13. The lighting board of claim 12, wherein said elastic arm is bent downward toward the second metal for elastically holding the cassette light unit in place.

14. The lighting board of claim 11, wherein said first metal includes two elastic arms supported in cantilever fashion by the insulating material, said arms being bent downward toward the second metal for contacting the top layer electrode plate and elastically holding the cassette light unit down against the second metal for fixing the cassette light unit in place after the cassette light unit has been inserted in the receptacle;

at least one of said elastic arms is in electrical contact with the top layer electrode plate; and said elastic arms are spaced from one another to define therebetween the open area in which the transparent head of the cassette light unit is received.

15. The lighting board of claim 14, wherein the first metal is U-shaped.

16. The cassette light unit of claim 11, wherein, when after the cassette light unit has been inserted in the receptacle, the transparent head extends from the bottom layer electrode plate upwardly beyond topmost surfaces of both the top layer electrode plate and the first metal.

17. The cassette light unit of claim 16, wherein, when after the cassette light unit has been inserted in the receptacle, the entirety of said cassette light unit, except said transparent head, is received in the spacing between said first and second metals.

* * * * *